US007137698B2

(12) United States Patent
Miyake et al.

(10) Patent No.: US 7,137,698 B2
(45) Date of Patent: Nov. 21, 2006

(54) RECORDING APPARATUS AND LIQUID EJECTION APPARATUS

(75) Inventors: Toshio Miyake, Nagano (JP); Kenji Yanagishita, Nagano (JP); Nobuyuki Nishi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/937,748

(22) Filed: Sep. 10, 2004

(65) Prior Publication Data

US 2005/0093953 A1 May 5, 2005

(30) Foreign Application Priority Data

Sep. 10, 2003 (JP) ..... P2003-317939
Sep. 10, 2003 (JP) ..... P2003-317949
Sep. 3, 2004 (JP) ..... P2004-256402
Sep. 3, 2004 (JP) ..... P2004-256404

(51) Int. Cl.
*B41J 2/01* (2006.01)
*B41J 3/407* (2006.01)

(52) U.S. Cl. ..... 347/104; 101/35

(58) Field of Classification Search ..... None
See application file for complete search history.

(56) References Cited

U.S. PATENT DOCUMENTS 5,241,353 A * 8/1993 Maeshima et al. ..... 399/405
2003/0234852 A1* 12/2003 Oshima et al. ..... 347/104

FOREIGN PATENT DOCUMENTS

| | | | |
|---|---|---|---|
| EP | 0 620 118 | A2 | 10/1994 |
| JP | 2-126853 | U | 10/1990 |
| JP | 4-40946 | U | 4/1992 |
| JP | 9-249343 | | 9/1997 |
| JP | 11-157723 | A | 6/1999 |
| JP | 2001-301277 | A | 10/2001 |
| JP | 2002-192782 | A | 7/2002 |
| JP | 2002-344990 | A | 11/2002 |
| JP | 2003-104590 | A | 4/2003 |
| JP | 2003-112458 | A | 4/2003 |
| JP | 2003-182889 | A | 7/2003 |
| JP | 2003-211757 | A | 7/2003 |
| JP | 2003-211759 | A | 7/2003 |

* cited by examiner

*Primary Examiner*—Daniel J. Colilla
(74) *Attorney, Agent, or Firm*—Sughrue Mion, PLLC

(57) ABSTRACT

A liquid ejection head is operable to eject a liquid droplet toward a target position. A transporter feeds a first target medium toward the target position in a first direction. An ejector ejects the first target medium to the outside of the apparatus. The ejector includes a first roller and a second roller adapted to nip the first target medium transported from the target position in the first direction. A guide member is disposed at a position closer to the outside of the apparatus than the ejector, and has a guide face along which a tray member on which a second target medium is mounted is fed toward the target position in a second direction which is opposite to the first direction. The guide member is pivotable between a first position for closing the guide face and a second position for opening the guide face to support the tray member.

10 Claims, 11 Drawing Sheets

RECORDING APPARATUS AND LIQUID EJECTION APPARATUS

BACKGROUND OF THE INVENTION

The present invention relates to a recording apparatus in which a recording head performs recording on an optical disk as a recording medium which is transported while being mounted on a tray. The present invention also relates to a liquid ejection apparatus in which a liquid ejection head ejects a liquid droplet toward an optical disk as a target medium which is transported while being mounted on a tray.

The term "liquid ejection apparatus" as used herein means that it includes not only a recording apparatus such as a printer in which an ink jet recording head is used to eject ink from the recording head and thus perform recording on the recording medium, a copying machine, and a facsimile machine, but an apparatus in which liquid corresponding to its application, instead of the ink, is ejected from a liquid ejection head corresponding to the aforesaid ink jet recording head toward a target medium corresponding to the recording medium. For example, the liquid ejection head includes a color material ejection head used in color filter manufacture for a liquid crystal display, etc., an electrode material (conductive paste) ejection head used in electrode formation for an organic EL display, a field emission display (FED), etc., and a specimen ejection head serving as a precision pipette.

As an ink jet printer (referred to hereinafter as a "printer") given as an example of the recording apparatus, there is one capable of recording directly on a label surface of an optical disk such as a compact disk. That is, the printer is configured such that a plate-shaped tray, on which the optical disk as a recording medium is mounted, is transported on a paper transporting path to be subjected to the recording operation.

In such a printer, an attachment for guiding the tray is detachably attached to the front side of the printer. The attachment is attached when the recording onto the optical disk is performed. The tray is fed to the recording section by a transporting roller while being supported by the attachment (see Japanese Patent Publication No. 2003-211757A).

In such a printer, when the attachment is not in use, it must be detached from the printed and managed separately. Further, it must be attached to the printer again when it is used. Such operations sometimes would be troublesome for a user.

Besides, such a printer comprises an ejection roller which ejects a transported medium (i.e., paper or the tray) to the outside of the printer. The ejection roller includes a drive roller and a follower roller. Since the follower roller is disposed at a side facing a recording surface of the medium, a toothed roller which is brought into point contact with the recording surface is adopted as the follower roller to avoid the ink transfer from the recording surface. However, in a case where the toothed roller comes in press contact with the label surface of the optical disk, there is anxiety that the recorded data placed immediately below the label surface is broken.

Accordingly, there is provided a releaser which moves the follower roller away from the drive roller in order to prevent the follower roller (toothed roller) from being brought into contact with the label surface of the optical disk. Such a releaser is operated by actuating a dedicated lever provided in the printer (see Japanese Patent Publication No. 2002-192782A). The follower roller and the lever is generally interlocked by way of a link.

In a case where the follower roller is configured to be interlocked with the movement of another component of the printer without providing the above dedicated lever, the number of components of the printer can be reduced and the downsizing of the printer can be attained. Further, careless actuation of the lever can be prevented. On the other hand, however, since a link for performing such an interlocking must be provided with high accuracy, thereby increasing the costs.

SUMMARY OF THE INVENTION

It is therefore an object of the invention to provide a convenient recording apparatus or a liquid ejection apparatus, in which recording or liquid ejection is performed with respect to a medium such as an optical disk with a simple and easy operation.

It is also an object of the invention to provide a recording apparatus or a liquid ejection apparatus, in which an ejection follower roller is moved interlocking with the movement of another component, and the positions of the ejection follower roller and the another component are precisely determined irrespective of tolerances of components of a link therebetween.

In order to achieve the above objects, according to the invention, there is provided a liquid ejection apparatus, comprising:

a liquid ejection head, operable to eject a liquid droplet toward a target position;

a transporter, which feeds a first target medium toward the target position in a first direction;

an ejector, which ejects the first target medium to the outside of the apparatus, the ejector comprising a first roller and a second roller adapted to nip the first target medium transported from the target position in the first direction;

a guide member, disposed at a position doser to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member.

With this configuration, since the apparatus is provided with the guide member which is selectably placed in either the first position (non-use condition) or the second position (use condition) by the simple and easy pivotal movement, it is very convenient for the user because it is not necessary to attach or detach the guide member in accordance with the situations of use, and it is therefore not necessary to separately manage the guide member from the apparatus.

Preferably, the guide member closes a part of a path through which the first target medium is transported, when the guide member is placed in the second position. The guide member opens the path when the guide member is placed in the first position.

With this configuration, the guide member in the non-use condition will not interfere with the transportation and the stacking of the first target medium.

Preferably, a stacker is disposed at a position closer to the outside of the apparatus than the ejector. The stacker being pivotable between a first position at which extending directions of the guide member placed in the first position thereof and the stacker are roughly made parallel to each other, and a second position for supporting the first target medium ejected by the ejector and allowing the guide member to be pivoted.

With this configuration, the guide member may be accommodated inside the stacker when the stacker is placed in the first position thereof, the installation space of the guide member can be reduced.

Preferably, a releaser places the second roller in a first position at which the second roller comes in contact with the first roller, when the guide member is pivoted to the first position, and places the second roller in a second position at which the second roller is separated from the first roller, when the guide member is pivoted to the second position thereof.

Here, it is preferable that the releaser comprises: a support member, which supports the second roller; a guide pin, extended from the support member; a guide plate, formed with a slot along which the guide pin is movable, the slot having a first end corresponding to the first position of the second roller and a second end corresponding to the second position of the second roller; an urging member; and a link, comprising a lever member, engaged with the guide pin and the urging member such that the guide pin is urged toward the first end of the slot when the guide member is placed in the first position thereof, and such that the guide pin is urged toward the second end of the slot when the guide member is placed in the second position.

With the above configurations, since the position of the guide pin (the second roller) is flexibly controlled by the link utilizing the urging force of the urging member. The link does not require so high precision, thereby reducing the costs. In other words, the positions of the guide member and the second roller can be controlled irrespective of the dimensional accuracies of the link.

It is further preferable that: the urging member urges the lever member in a single direction; and the lever member is so configured that the direction urging the guide pin is changed in accordance with a pivoted angle of the guide member.

With this configuration, the releaser can be realized with a simple and low-cost structure.

It is also preferable that the link comprises a lever member having a first end portion formed with a hole to which the guide pin is loosely fitted, and a second end portion fitted with a rotary shaft of the first roller so as to be pivotable thereabout.

With this configuration, since a part of the link is provided with the rotary shaft of the first roller, the installation space and the component cost can be reduced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

One embodiment of the invention will be described below with reference to the accompanying drawings.

Figure 1:
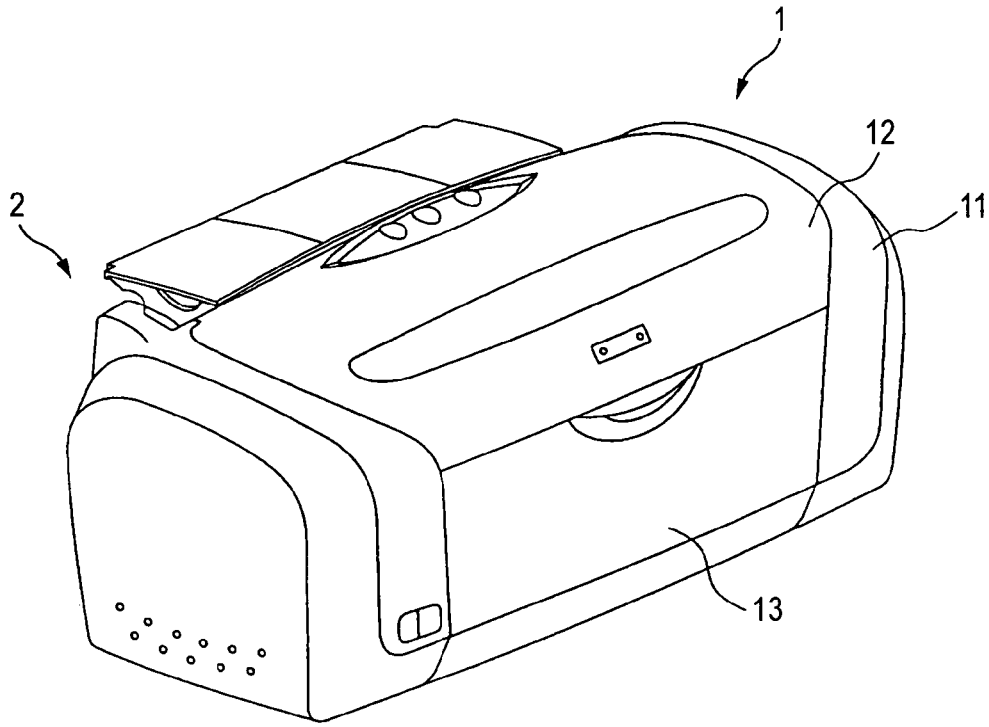
FIG. 1 is a perspective view of a printer according to one embodiment of the invention, showing a state that a stacker is closed.

As shown in FIG. 1, a printer 1 is provided with a feeder 2 at the rear part thereof, on which recording paper (hereinafter, referred as paper P) is mounted in an inclined posture. A stacker 13 is provided on a lower casing 17 (see FIG. 5) which constitutes a bottom section of the printer 1. The stacker 13 includes a stacker body 14 and a substacker 15, and is pivotable about a pivot shaft 14*a* (see FIG. 5) between a closed position shown in FIG. 1 and an opened position shown in FIG. 3. When a user opens the stacker body 14 and pulls out the substacker 15, a stacking face on which the paper P is stacked can be made.

An upper center part of a housing 11, a cover 12 is provided. The cover 12 is opened when the operation for replacing an ink cartridge is performed, for example.

Figure 2:
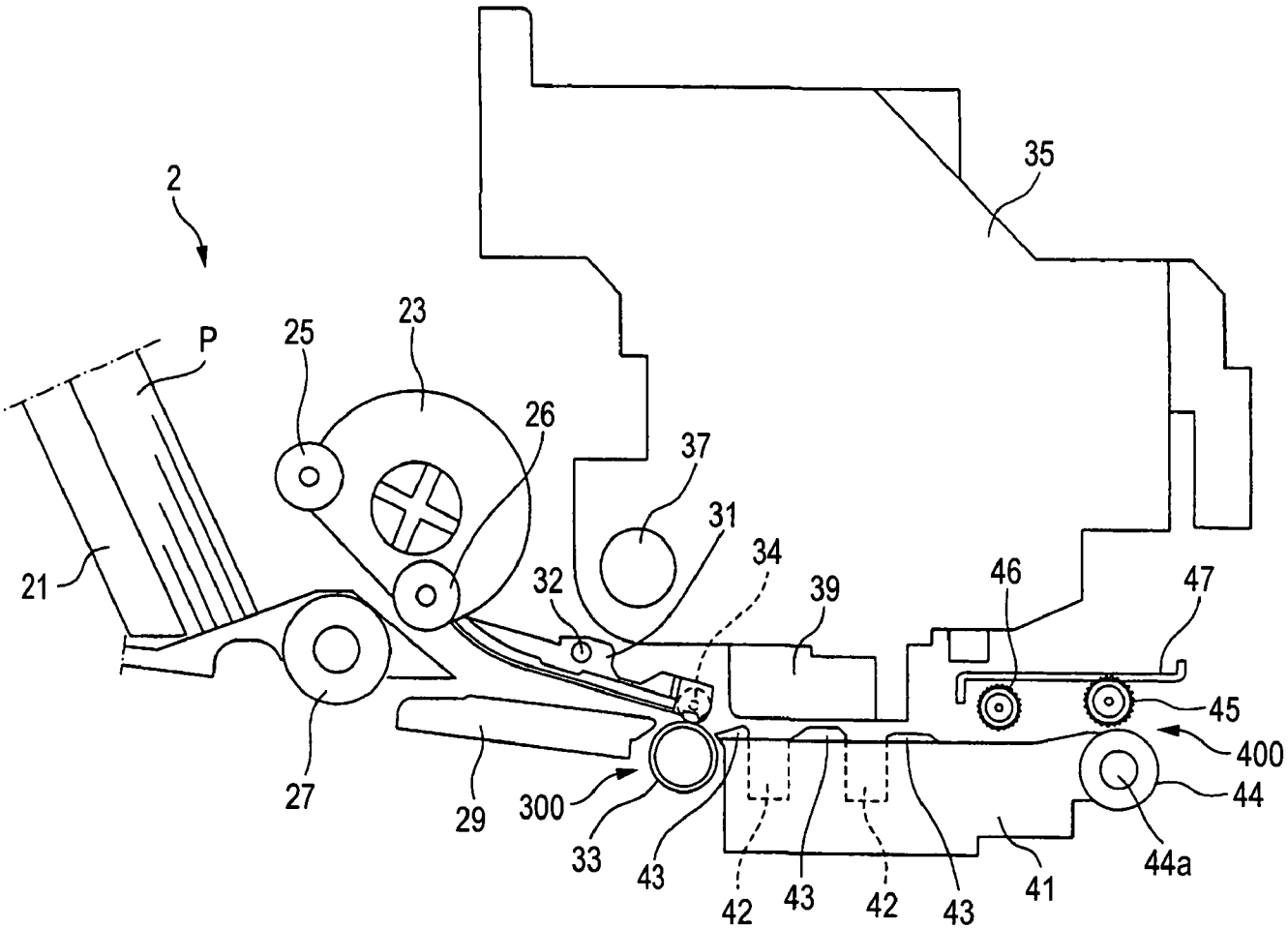
FIG. 2 is a schematic view of an internal structure of the printer.

As shown in FIG. 2, the feeder 2 comprises a hopper 21, a feeding roller 23, a retard roller 27, and guide rollers 25, 26 to feed paper P one by one toward a transporter 300 disposed an upstream side of a recording head 39. The transporter 300 comprises a drive roller 33 and a follower roller 34 which is brought into press contact with the drive roller 33 to be rotated by the rotation of the drive roller 33.

More specifically, the hopper 21 is a plate-shaped member which is pivotable about a not-shown pivot center provided at an upper end portion thereof. By the pivot movement of the hopper 21, the paper P stacked thereon is brought into contact with the feeding roller 23 or separated therefrom. The feeding roller 23 has a D-shaped cross section such that an arcuate portion comes in contact with the paper P to be fed to the downstream side of the paper transporting path. The rotation of the feeding roller 23 is so controlled that a flat portion opposes to the paper P when the paper P is nipped between the drive roller 33 and the follower roller 34, in order to reduce the transportation resistance. This condition is shown in FIG. 2.

The retard roller 27 is configured so as to come in press contact with the arcuate portion of the feeding roller 23. In a case where a single sheet of the paper P is duly fed, the retard roller 27 is rotated (clockwise in FIG. 2) while coming in contact with the paper P. In a case where there are plural sheets of the paper P between the retard roller 27 and the feeding roller 23, the retard roller 27 is not rotated because a friction coefficient between the sheets is smaller than a friction coefficient between the retard roller 27 and the paper P. Therefore, the uppermost paper P is certainly separated from the next paper P and duly fed, thereby avoiding the overlapped feeding of the paper P.

The guide rollers 25, 26 are freely rotatable so as to prevent the transporting resistance from generating when the paper P transported by the drive roller 33 and the follower roller 34 comes in contact with the feeding roller 23.

The paper P fed by the feeder 2 reaches the transporter 300 while being guided by a guide member 29. The follower roller 34 is rotatably supported on a holder 31. The holder 31 is attached on a not-shown main frame which constitutes a base body of the printer 1 by way of a not-shown spring. The paper P having reached the transporter 300 is transported to the downstream of the paper transporting path by the rotation of the drive roller 33 with a fixed pitch.

The recording head 39 is disposed at the downstream side of the transporter 300. A platen 41 is disposed so as to oppose to the recording head 39. The recording head 39 is mounted on a bottom portion of a carriage 35 which is reciprocately moved in a primary scanning direction while being guided by a guide shaft 37. Independent ink cartridges (not shown) for a plurality colors are mounted on the carriage 35 so that the respective colors of ink are supplied to the recording head 39 within the carriage 35.

The platen 41 for defining a distance between the paper P and the recording head 39 is formed with a plurality of ribs 43 and a plurality of recesses 42. Ink ejected to the outside of the paper P is received by an ink absorbing member (not shown) disposed within each of the recesses 42, so that a marginless printing in which printing is performed without providing any margins at the ends of the paper P can be realized. The discarded ink is lead to a waste ink tray (not shown) disposed below the platen 41 through the ink absorbing member.

There are provided an auxiliary roller 46 and an ejector 400 comprising drive rollers 44 and follower rollers 45 at the downstream side of the recording head 39. The drive rollers 44 are arrayed on a rotary shaft 44*a*. The follower rollers 45 are arrayed on a frame 47 formed from a metal plate elongated in the primary scanning direction, and respectively brought into contact with the drive rollers 44 to be rotated by the rotation of the rotary shaft 44*a*. The paper P which has been subjected to the recording operation is nipped by these rollers to be ejected toward the stacker 13. The auxiliary roller 46 arranged at the upstream side of the ejector 400 comes in contact with the paper P from above and is rotated by the transportation of the paper P while restricting an upward movement of the paper P, thereby maintaining the distance between the paper P and the recording head 39.

Figure 4:
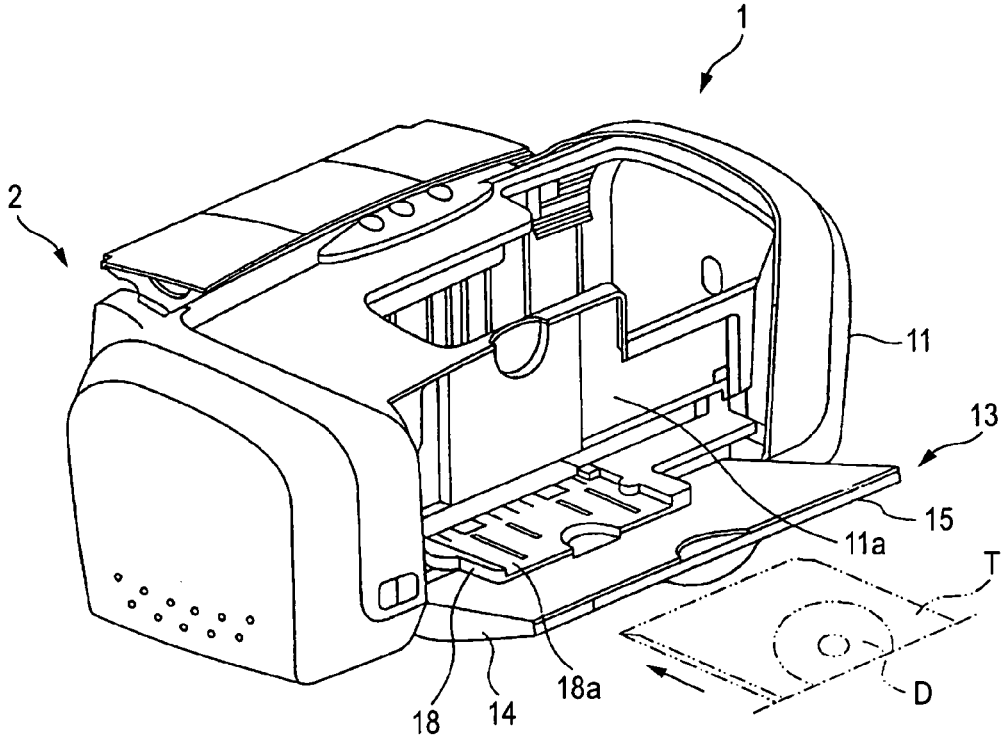
FIG. 4 is a perspective view of the printer, showing a state that the stacker is opened and the tray guide is opened.

The printer 1 is adapted to perform the ink jet recording with respect to the label surface of the optical disk such as a compact disk, in addition to the above described paper P. As shown in FIG. 4, the optical disk D is transported along the paper transporting path while being mounted on a plate-shaped tray T. The tray T is individually provided from the printer 1, and is inserted from the front side of the printer 1 while being guided by a tray guide 18.

Figure 3:
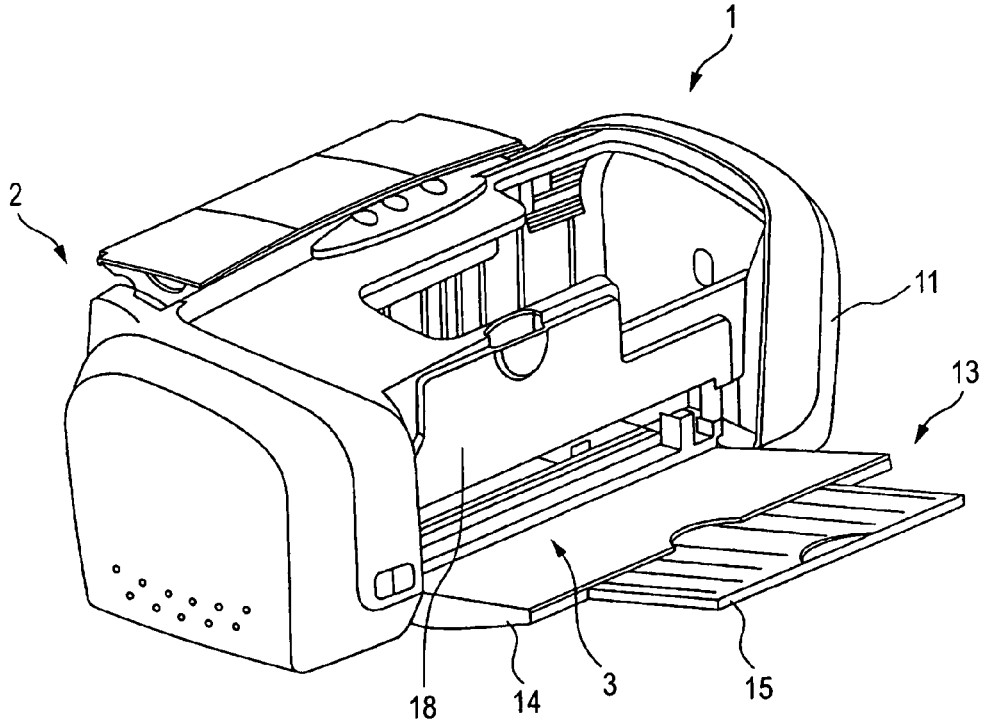
FIG. 3 is a perspective view of the printer, showing a state that the stacker is opened and a tray guide is closed.
Figure 5:
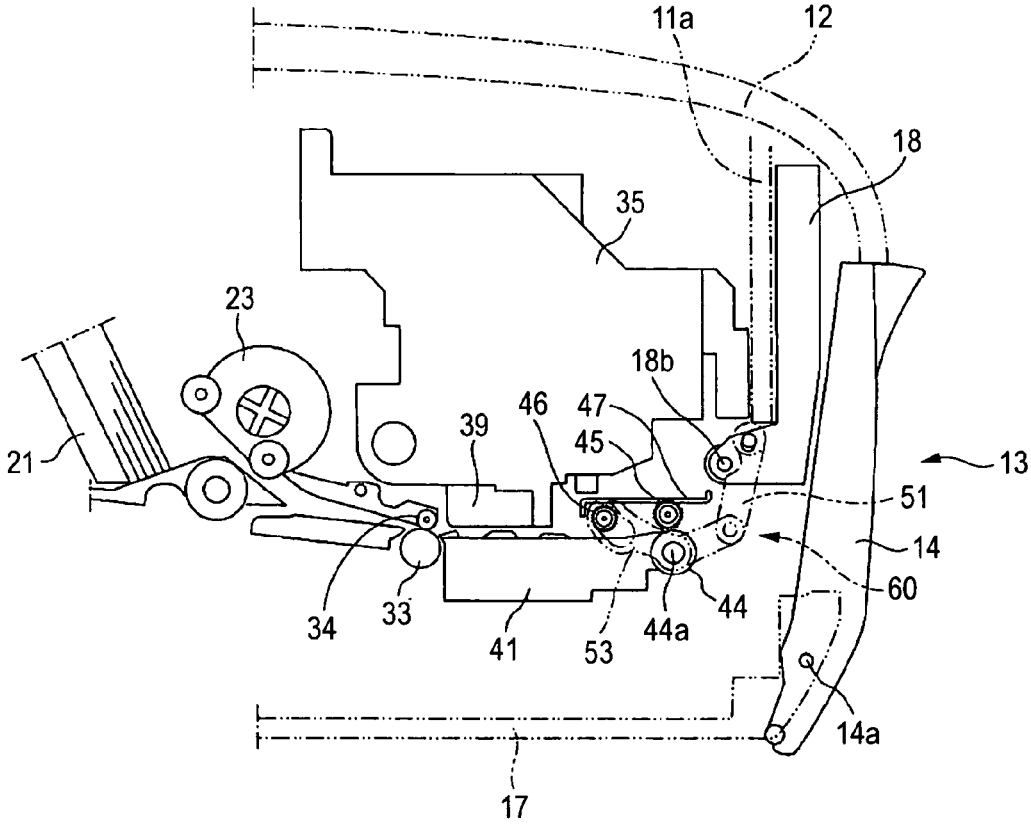
FIG. 5 is a side view of the printer, showing a state that the stacker is closed and the tray guide is closed.

The tray guide 18 is disposed at the downstream side of the ejector 400 so as to be pivotable between a closed (vertical) position shown in FIG. 3 and an opened (horizontal) position for supporting the tray T shown in FIG. 4. FIGS. 1 and 5 show a state that both of the tray guide 18 and the stacker 13 are in the closed position. In this state, since the tray guide 18 is placed inside the stacker 13, the installation space of the tray guide 18 can be reduced.

Figure 6:
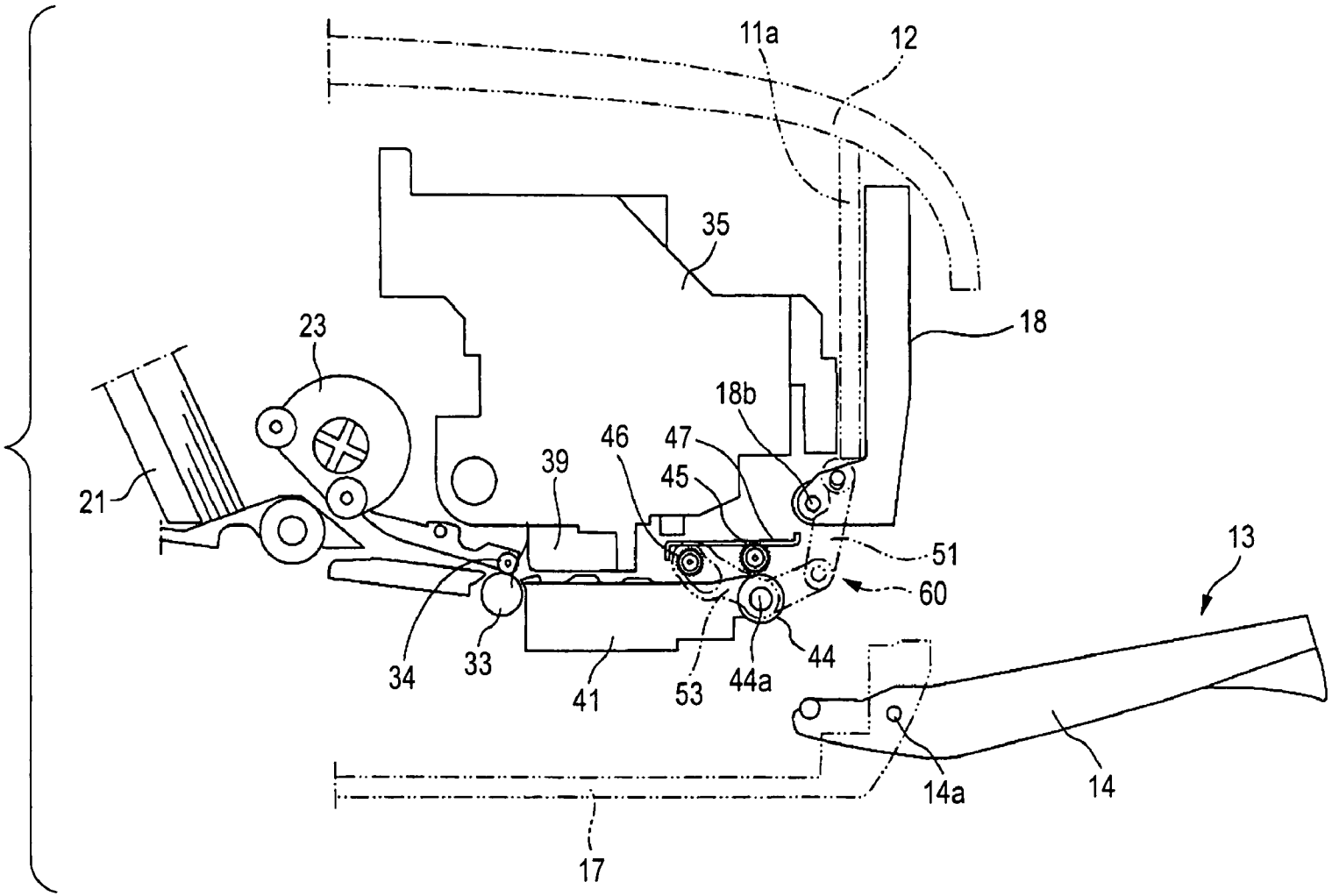
FIG. 6 is a side view of the printer, showing a state that the stacker is opened and the tray guide is closed.
Figure 7:
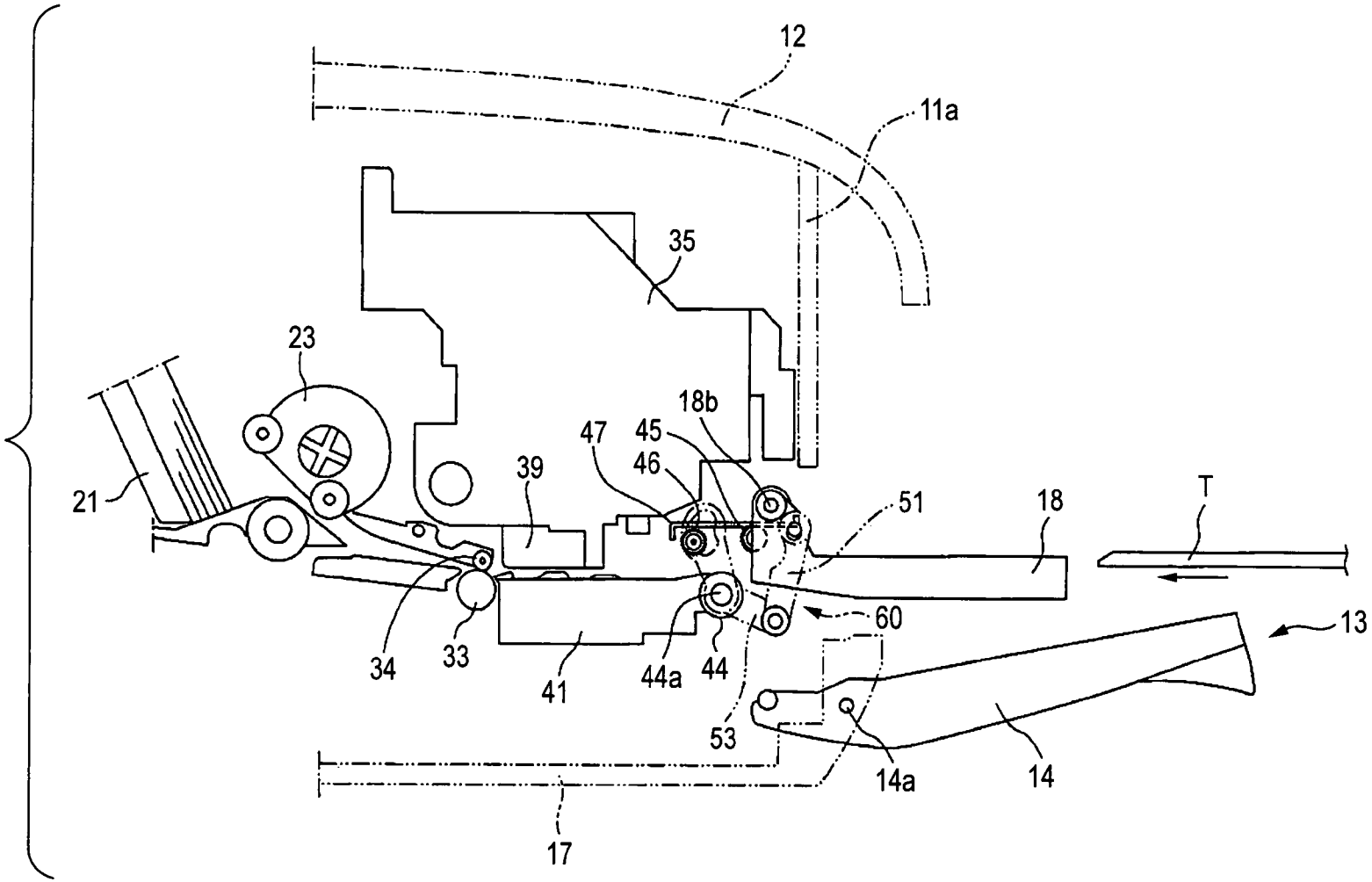
FIG. 7 is a side view of the printer, showing a state that the stacker is opened and the tray guide is opened.

FIGS. 3 and 6 show a state that the stacker 13 is in the opened position but the tray guide 18 is in the closed position. FIGS. 4 and 7 show a state that both of the stacker 13 and the tray guide 18 are in the closed position. In this state, the stacker 13 is slightly inclined upward to prevent the stacked paper P from being dropped.

Since the printer 1 is provided with the tray guide 18 which is selectably placed in either the closed condition (non-use condition) or the opened condition (use condition) by the simple and easy pivotal movement, it is very convenient for the user because it is not necessary to attach or detach the tray guide 18 in accordance with the situations of use, and it is therefore not necessary to separately manage the tray guide 18 from the printer 1.

As shown in FIGS. 4 and 7, the tray guide 18 closes a part of the paper transporting path when it is placed in the opened position, while the tray guide 18 is escaped from the paper transporting path when it is placed in the closed position. Therefore, the tray guide 18 in the non-use condition will not interfere with the transportation and the stacking of the normal target medium (i.e., the paper P).

Next, a releaser 50 for separating the follower rollers 45 from the drive rollers 44 will be described. Specifically, the releaser 50 moves the follower rollers 45 between a first position at which the follower rollers 45 are brought into contact with the drive rollers 44 and a second position at which the follower rollers 45 are separated from the drive rollers 44. Toothed rollers which are brought into point contact with the recording surface are adopted as the follower rollers 45 to avoid the ink transfer from the recording surface. However, in a case where the toothed rollers come in press contact with the label surface of the optical disk D, there is anxiety that the recorded data placed immediately below the label surface is broken. Therefore, the releaser 50 separates the follower rollers 45 from the drive rollers 44 when the recording is performed directly onto the label surface of the optical disk D, so that the follower rollers 45 are prevented from coming in contact with the label surface of the optical disk D.

Figure 8:
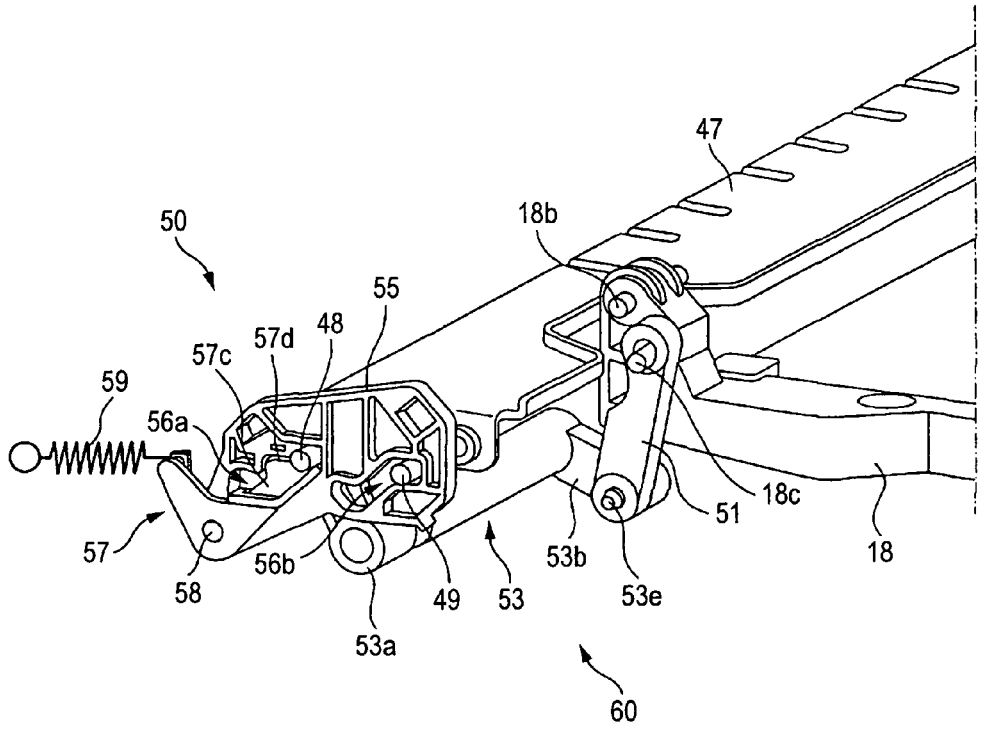
FIG. 8 is a perspective view of a releaser incorporated in the printer.
Figure 9:
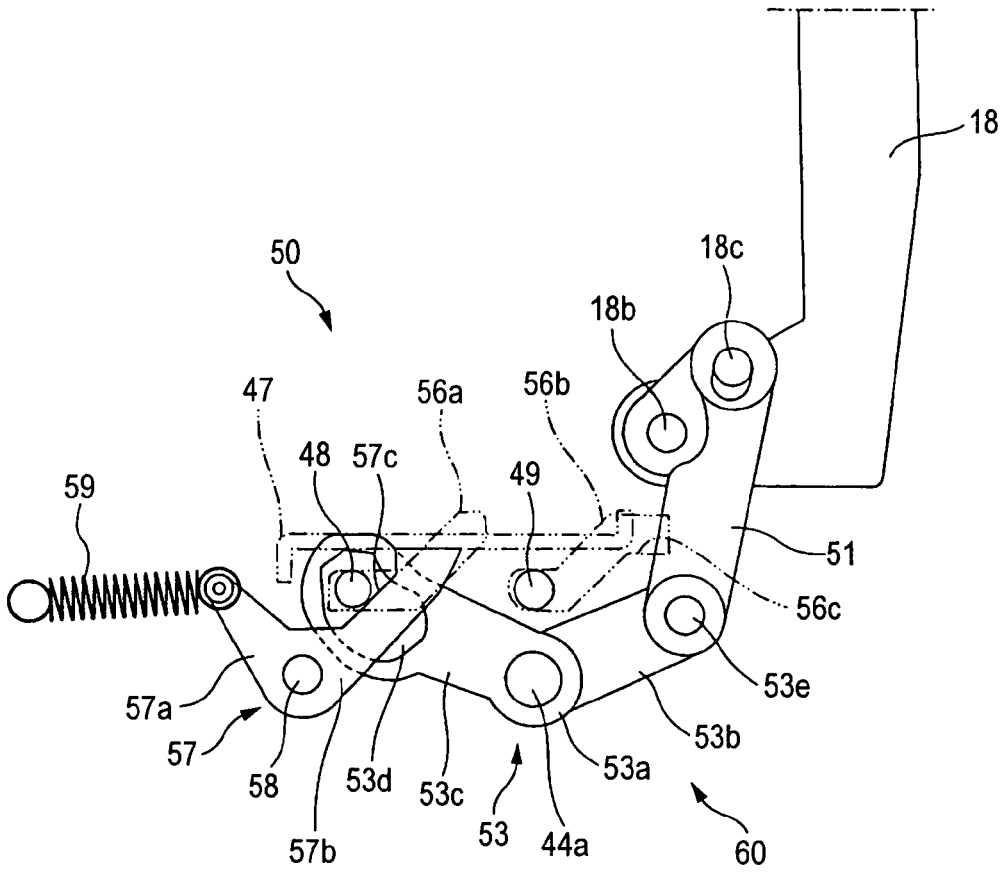
FIG. 9 is a side view of the releaser, showing a state that the tray guide is closed.

The releaser 50 is configured such that the follower rollers 45 are separated from the drive rollers 44 interlocking with the pivotal movement of the tray guide 18 by way of a link 60. As shown in FIGS. 8 and 9, the link 60 comprises a link rod 51 and a link lever 53. More specifically, the link lever 53 includes a cylindrical portion 53*a* and lever portions 53*b*, 53*c* extended from the cylindrical portion 53*a*. The cylindrical portion 53*a* is fitted with an end of the rotary shaft 44*a*, so that the link lever 53 is pivotable about the rotary shaft 44*a* (clockwise or counterclockwise in FIG. 9). The link rod 51 is engaged with a projection 18*c* which is arranged in an offset position from a pivot shaft 18*b* of the tray guide 18, while being engaged with a projection 53*e* provided on the lever portion 53*b* of the link lever 53 so as to link the tray guide 18 and the link lever 53.

Two guide pins 48, 49 are extended from each of longitudinal ends of the frame 47 supporting the drive rollers 45, and are loosely fitted into guide slots 56*a*, 56*b* formed in a guide plate 55 arranged adjacent to each of the longitudinal ends of the frame 47. The guide slots 56*a*, 56*b* are step-shaped slots. The frame 47 is displaced in accordance with the movement of the guide pins 48, 49 within the guide slots 56*a*, 56*b*, thereby changing the height position of the follower rollers 45 relative to the drive rollers 44.

The frame 47 is configured so as to be displaced also by the link lever 53. Specifically, a hole 53*d* is formed in an end portion of the lever portion 53*c*, and the guide pin 48 is loosely fitted into the hole 53*d*. When the tray guide 18 is pivoted about the pivot shaft 18*b*, the link 60 is operated such that the lever portion 53*c* pushes the guide pin 48 so as to move along the guide slot 56*a*, thereby displacing the frame 47.

Figure 10:
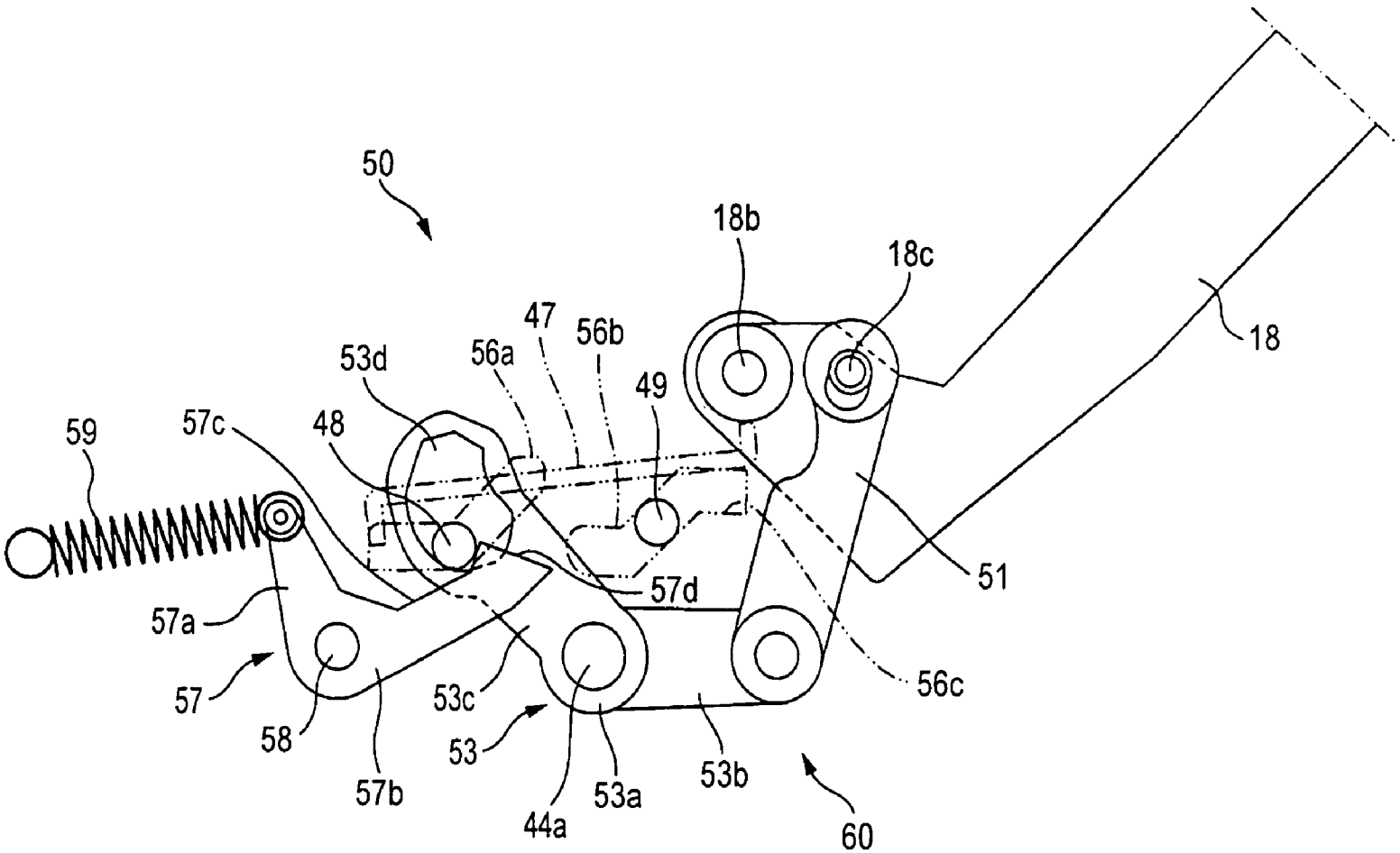
FIG. 10 is a side view of the releaser, showing a state that the tray guide is operated.
Figure 11:
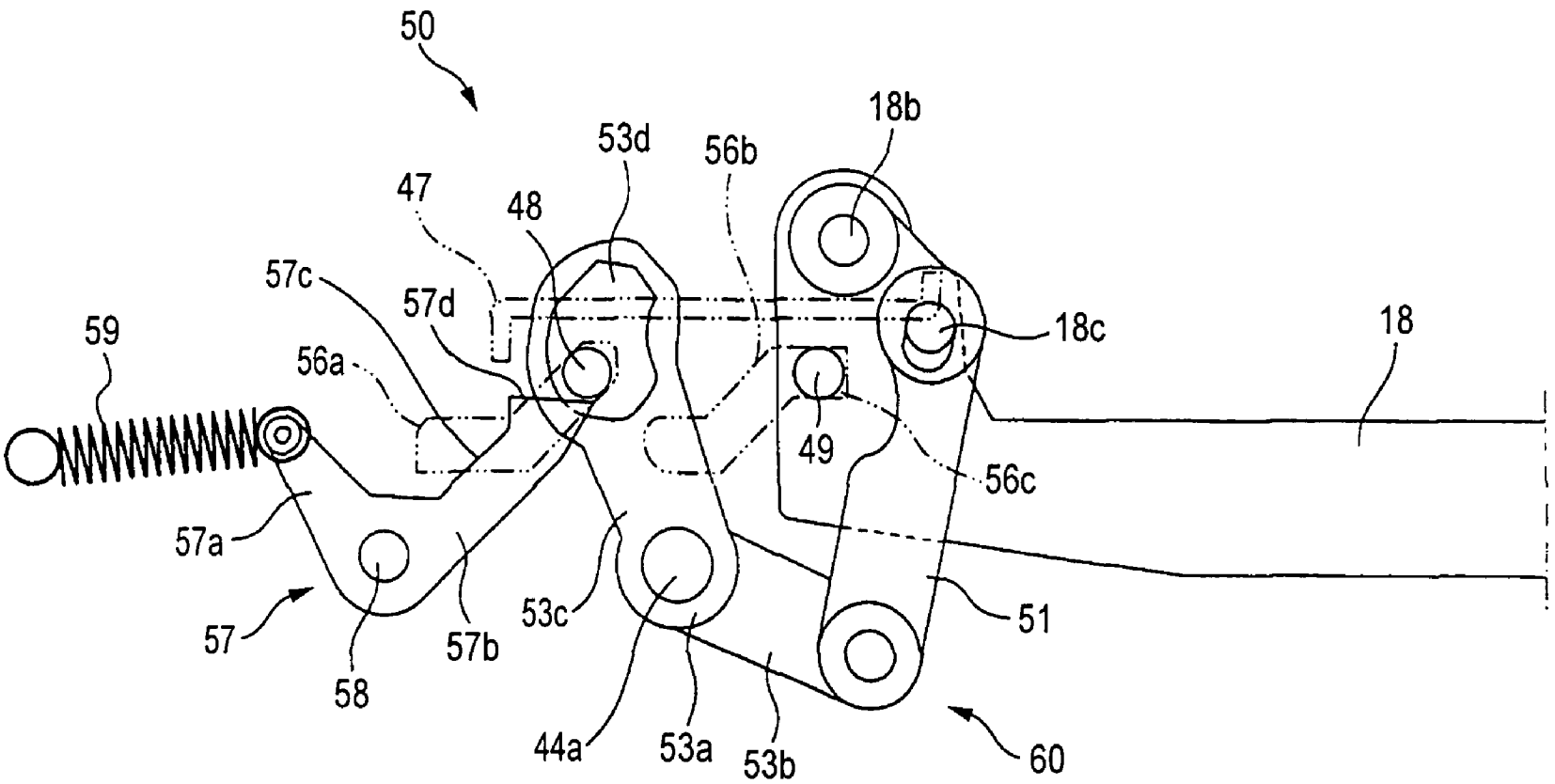
FIG. 11 is a side view of the releaser, showing a state that the tray guide is opened.

Since the guide slots 56*a*, 56*b* extend stepwise, the frame 47 slides forward (the right side in the drawings) while being displaced upward as shown in FIGS. 9 to 11. This movement is to avoid the carriage 35 which is situated immediate above the frame 47 in the condition of FIG. 9. That is, the frame 47 can be displaced upward without colliding with the carriage 35.

As shown in FIGS. 9 and 11, the guide pin 48 is held at positions corresponding to the first and second positions of the follower rollers 45, not by the lever portion 53*c* but by a V-shaped lever member 57 which is pivotable about a pivot shaft 58. An urging force generated by a tension spring 59 is applied to one end 57*a* of the lever member 57, so that the lever member 57 is pivotable counterclockwise in FIG. 9. The other end 57*b* of the lever member 57 is engaged with the guide pin 48. As shown in FIG. 9, a slope face 57*c* pushes the guide pin 48 toward the lower end of the guide slot 56*a* (the left side of the drawings) so that the follower rollers 45 are held in the first position (i.e., the position coming in contact with the drive rollers 44). On the other hand, as shown in FIG. 11, a top face 57*d* pushes the guide pin 48 toward the upper end of the guide slot 56*a* so that the follower rollers 45 are held in the second position (i.e., the position being separated from the drive rollers 44).

In the state shown in FIGS. 1 and 5, the tray guide 18 is placed at the closed position so as to extend vertically along a wall 11*a* which extend downward from the upper front part of the housing 11. The stacker 13 is also placed at the closed position so as to extend vertically along the tray guide 18.

In the state shown in FIGS. 3 and 6, only the stacker 13 is pivoted forward to establish a condition that the normal target medium such as the paper P can be stacked thereon. A stopper (not shown) is provided to define the inclined angle of the stacker 13 such that the paper P ejected by the ejector 400 is prevented from being dropped from the stacker 13.

In the state shown in FIGS. 4 and 7, both of the stacker 13 and the tray guide 18 are pivoted forward to establish a condition that the tray T can be inserted from the front section of the printer 1. A stopper (not shown) is provided to stop the pivotal movement of the tray guide 18 such that a guide face 18*a* (see FIG. 4) extends horizontally, thereby the tray guide 18 can be horizontally led to the paper transporting path.

When the tray guide 18 is operated so as to move from the closed position shown in FIG. 6 to the opened position shown in FIG. 7, as shown in FIGS. 9 to 11, an inner periphery of the hole 53*d* in the lever portion 53*c* is first brought into contact with the guide pin 48 in accordance with the pivotal movement of the tray guide 18, so that the guide pin 48 is slid along the guide slot 56*a*. Incidentally, the lever member 57 is pivoted clockwise in FIG. 10 by the guide pin 48 against the elastic force of the tension spring 59.

When the guide pin 48 reaches the top face 57*d*, the direction of the urging force that the guide pin 48 receives from the lever member 57 changes. That is, when the guide pin 48 is in contact with the slope face 57*c* of the lever member 57, the guide pin 48 is urged toward the lower left end of the guide slot 48, thereby holding the follower rollers 45 at the first position. On the other hand, when the guide pin 48 is in contact with the top face 57*d* of the lever member 57, since the guide member 48 is loosely fitted with the hole 53*d*, it is urged toward the upper right end of the guide slot 56*a*, thereby holding the follower rollers 45 at the second position. Although the lever member 57 is merely urged in one direction by the single tension spring 59, the slope face 57*c* and the top face 57*d* are configured so as to be able to change the urging direction for the guide pin 48 on the other hand.

The guide pin 49 is moved along the guide slit 56*b* in accordance with the displacement of the guide pin 48. The guide slit 56*b* is formed with a flat section 56*c* at the upper end thereof to prevent the guide pin 49 which is not provided with any urging member from displacing downward. FIG. 11 shows a state that the guide pin 49 is held at the flat section 56*c*.

In other words, the releaser 50 comprises a bi-stabilizer in which the direction that the lever member 57 urges the guide pin 48 is switched in accordance with the pivot angle of the tray guide 18 through the use of the single tension spring 59 which urges the lever member 57 in the single direction. Accordingly, the releaser 50 can be configured with a simple structure at a low cost. Although it is not shown, at the side of the other longitudinal end of the frame 47, the same releaser 50 is provided.

The tray guide 18 for changing the height position of the driven rollers 45 must be provided with a certain precision in connection with the range of the pivotal movement, in order to establish the positional relationship shown in FIG. 5 relative to the wall 11*a* and the stacker 13, for example. On the other hand, the driven rollers 45 must be provided with a certain precision in order to prevent the driven rollers 45 at the first position from being pressed against the drive rollers 44 excessively, and to secure the distance between the driven rollers 45 at the second position and the label surface of the optical disk D. In this context, the link rod 51 and the link lever 53 for interlocking the tray guide 18 and the guide pin 48 need to be provided with high precision increasing the costs.

However, in this embodiment, since the position of the guide pin 48 (the follower rollers 45) is flexibly controlled by the link 60 utilizing the urging force of the tension spring 59. The link rod 51 and the link rod 53 do not require so high precision, thereby reducing the costs. In other words, the positions of the tray guide 18 and the driven rollers 45 can be controlled irrespective of the dimensional accuracies of the link rod 51 and the link lever 53.

In this embodiment, the driven rollers 45 are interlockingly displaced in accordance with the pivotal movement of the tray guide 18 by way of the link 60. However, the driven rollers 45 may be interlocked with the movement of another component in the printer 1 by way of a link configured as described the above. If such a component must be provided with a certain precision for some reasons, the above described advantages can be attained effectively.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A liquid ejection apparatus, comprising:

a liquid ejection head, operable to eject a liquid droplet toward a target position;

a transporter, which transports a first target medium toward the target position in a first direction;

an ejector, which ejects the first target medium to the outside of the apparatus, the ejector comprising a first roller and a second roller adapted to nip the first target medium transported from the target position in the first direction; and a guide member, disposed at a position closer to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member, wherein:

the guide member closes a part of a path through which the first target medium is transported, when the guide member is placed in the second position; and the guide member opens the path when the guide member is placed in the first position.

2. A liquid ejection apparatus, comprising:

a liquid ejection head, operable to eject a liquid droplet toward a target position;

a transporter, which transports a first target medium toward the target position in a first direction;

an ejector, which ejects the first target medium to the outside of the apparatus, the ejector comprising a first roller and a second roller adapted to nip the first target medium transported from the target position in the first direction;

a guide member, disposed at a position closer to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member; and a stacker, disposed at a position closer to the outside of the apparatus than the ejector, the stacker being pivotable between a first position at which extending directions of the guide member placed in the first position thereof and the stacker are roughly made parallel to each other, and a second position for supporting the first target medium ejected by the ejector and allowing the guide member to be pivoted.

3. A liquid ejection apparatus, comprising:

a liquid ejection head, operable to eject a liquid droplet toward a target position;

a transporter, which transports a first target medium toward the target position in a first direction;

an ejector, which ejects the first target medium to the outside of the apparatus, the ejector comprising a first roller and a second roller adapted to nip the first target medium transported from the target position in the first direction;

a guide member, disposed at a position closer to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member; and a releaser which places the second roller in a first position at which the second roller comes in contact with the first roller, when the guide member is pivoted to the first position, and places the second roller in a second position at which the second roller is separated from the first roller, when the guide member is pivoted to the second position thereof.

4. The liquid ejection apparatus as set forth in claim 3, wherein the releaser comprises:

a support member, which supports the second roller;

a guide pin, extended from the support member;

a guide plate, formed with a slot along which the guide pin is movable, the slot having a first end corresponding to the first position of the second roller and a second end corresponding to the second position of the second roller;

an urging member; and a link, comprising a lever member, engaged with the guide pin and the urging member such that the guide pin is urged toward the first end of the slot when the guide member is placed in the first position thereof, and such that the guide pin is urged toward the second end of the slot when the guide member is placed in the second position.

5. The liquid ejection apparatus as set forth in claim 4, wherein:

the urging member urges the lever member in a single direction; and the lever member is so configured that the direction urging the guide pin is changed in accordance with a pivoted angle of the guide member.

6. The liquid ejection apparatus as set forth in claim 4, wherein the link comprises a lever member having a first end portion formed with a hole to which the guide pin is loosely fitted, and a second end portion fitted with a rotary shaft of the first roller so as to be pivotable thereabout.

7. The liquid apparatus as set forth in claim 2, wherein the guide member and the stacker are adapted to be moved independently from each other.

8. The liquid ejection apparatus as set forth in claim 7, wherein the guide member is capable of being held in the first position thereof when the stacker is placed in the second position thereof.

9. A liquid ejection apparatus, comprising:

a liquid ejection head, operable to eject a liquid droplet toward a target position;

a transporter, which transports a first target medium toward the target position in a first direction;

an ejector, which ejects the first target medium to the outside of the apparatus, the ejector comprising a first roller and a second roller adapted to nip the first target medium transported from the target position in the first direction; and a guide member, disposed at a position closer to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member, wherein the guide member is pivotable about a pivot center located above a passage through which the first target medium is transported.

10. A liquid ejection apparatus, comprising:

a liquid ejection head, operable to eject a liquid droplet toward a target position;

a transporter, which transports a first target medium toward the target position in a first direction;

an ejector, which ejects the first target medium to the outside of the apparatus, the ejector comprising a first roller and a second roller adapted to nip the first target medium transported from the target position in the first direction; and a guide member, disposed at a position closer to the outside of the apparatus than the ejector, and having a guide face along which a tray member on which a second target medium is mounted is fed toward the target position in a second direction which is opposite to the first direction, the guide member being pivotable between a first position for closing the guide face and a second position for opening the guide face to support the tray member, wherein the guide face of the guide member serves as an extended part of a passage through which the first target medium is transported, when the guide member is placed at the second position thereof.

* * * * *